United States Patent [19]

Barlow

[11] Patent Number: 4,952,189

[45] Date of Patent: Aug. 28, 1990

[54] SPINABLE DOLL

[75] Inventor: Gordon A. Barlow, Highland Park, Ill.

[73] Assignee: Gordon Barlow Design, Skokie, Ill.

[21] Appl. No.: 456,545

[22] Filed: Dec. 26, 1989

[51] Int. Cl.[5] ..... A63H 1/06; A63H 3/46; A63H 11/00

[52] U.S. Cl. ..... 446/241; 446/366; 446/378; 446/383

[58] Field of Search ..... 446/241, 330, 359, 378, 446/376, 366, 236, 333, 383

[56] References Cited

U.S. PATENT DOCUMENTS

| | | | |
|---|---|---|---|
| 3,277,601 | 10/1966 | Ryan | 446/378 |
| 3,700,384 | 10/1972 | Gardel et al. | 446/330 X |
| 3,994,092 | 11/1976 | Sapkus et al. | 446/378 X |
| 4,182,076 | 1/1980 | Gay et al. | 446/333 X |
| 4,304,064 | 12/1981 | Kulesza et al. | 446/241 |

*Primary Examiner*—Mickey Yu

*Attorney, Agent, or Firm*—Kinzer, Plyer, Dorn, McEachran & Jambor

[57] ABSTRACT

A spinable balleria doll having a body, legs, feet arms, hands and a head. A pushrod extends through the body and out of the head. The pushrod is mounted for reciprocal movement relative to the doll. The pushrod engages a square drive nut located in the body of the doll to rotate the body as the pushrod is pushed into the body. Each leg is connected to the body and each foot is connected to its leg to permit rotation of one relative to the other. Releasable detents and teeth are associated with the body, legs and feet to permit each leg to be held in selected positions of rotation relative to the body and each foot to be held in selected positions of rotation relative to its leg.

9 Claims, 2 Drawing Sheets

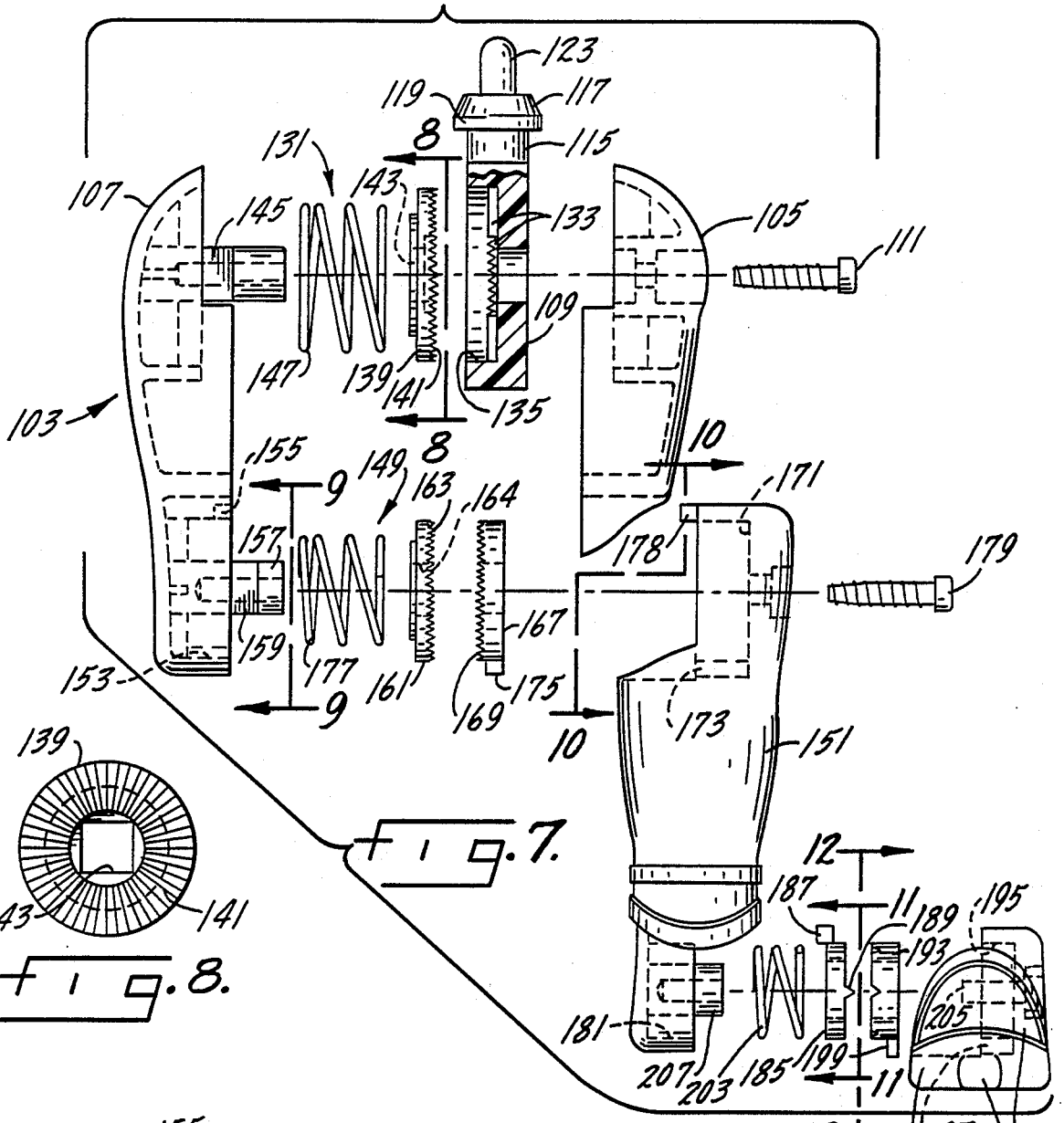
Fig. 7.
Fig. 8.
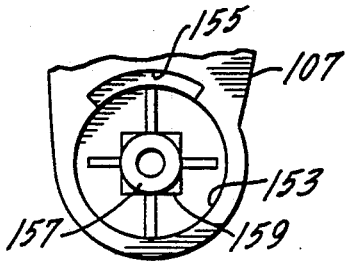
Fig. 9.
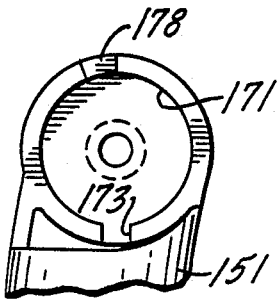
Fig. 10.
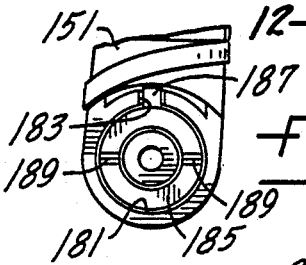
Fig. 11.
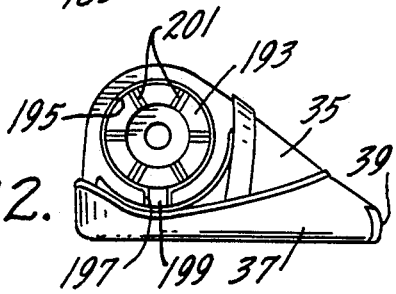
Fig. 12.

SPINABLE DOLL

BACKGROUND AND SUMMARY OF THE INVENTION

This invention is concerned with a toy doll of the poseable type and, in particular, with a toy doll having the appearance of a ballerina which can be spun on one toe for pirouetting.

An object of this invention is a toy ballerina doll having a pushrod spinning mechanism and legs which can be locked in position in general alignment with the pushrod so that the doll can pirouette on a toe in the manner of an actual ballerina.

An object of this invention is a toy plastic doll having legs that can be moved both laterally and forward and aft relative to the body with means to releasably hold each leg in its selected position of movement.

Other objects may be found in the following specification, claims and drawings.

BRIEF DESCRIPTION OF THE DRAWINGS

The invention is illustrated more or less diagrammatically in the following drawings wherein:

FIG. 7 is an exploded, enlarged view of the left leg of the doll;

FIG. 8 is a view taken along line 8—8 of FIG. 7;

FIG. 9 is a view taken along line 9—9 of FIG. 7;

FIG. 10 is a view taken along line 10—10 of FIG. 7;

FIG. 11 is a view taken along line 11—11 of FIG. 7; and

FIG. 12 is a view taken along line 12—12 of FIG. 7.

DESCRIPTION OF THE PREFERRED EMBODIMENT

Figure 1:
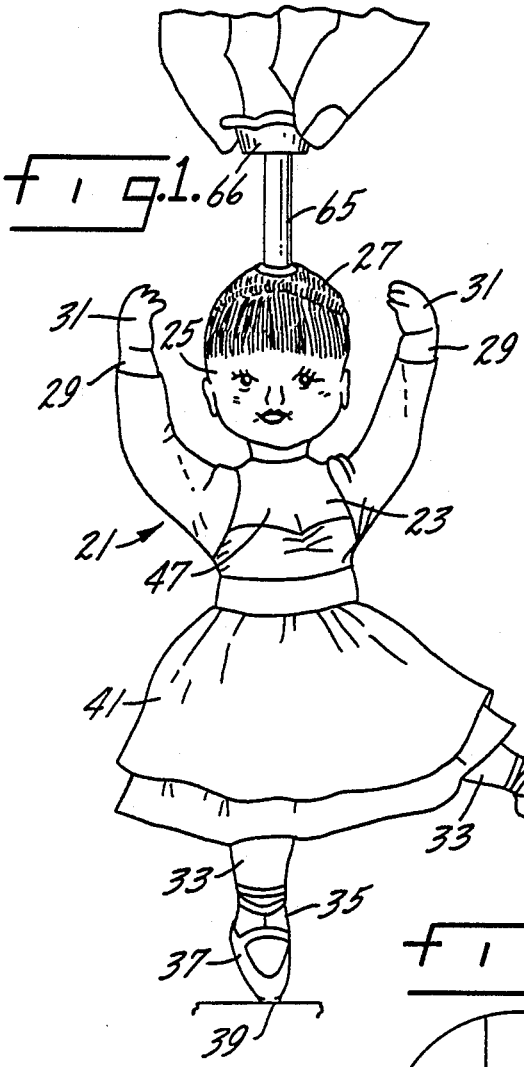
FIG. 1 is a front elevational view of the doll of this invention in its pirouetting position.

FIG. 1 of the drawings shows a ballerina doll 21 embodying the novel aspects of this invention pirouetting. The doll has a torso 23, a head 25, hair 27, arms 29, hands 31, legs 33 and feet 35. Replicas of slippers 37 are formed on the feet and each slipper has a dancing toe 39. As is conventional, the parts of the doll are made of plastic, with the head being formed of soft vinyl and having artificial hair 27. The doll's dress 41 is formed of fabric and is removable, as is conventional.

The doll 21 includes a front half 47 of the torso 23 and a rear half 49 held together by screws (not shown) which extend through cooperating hollow posts 53 and through solid posts which fit into hollow posts and are not shown for clarity of illustration, both of which are formed integrally with the halves of the torso.

Figure 2:
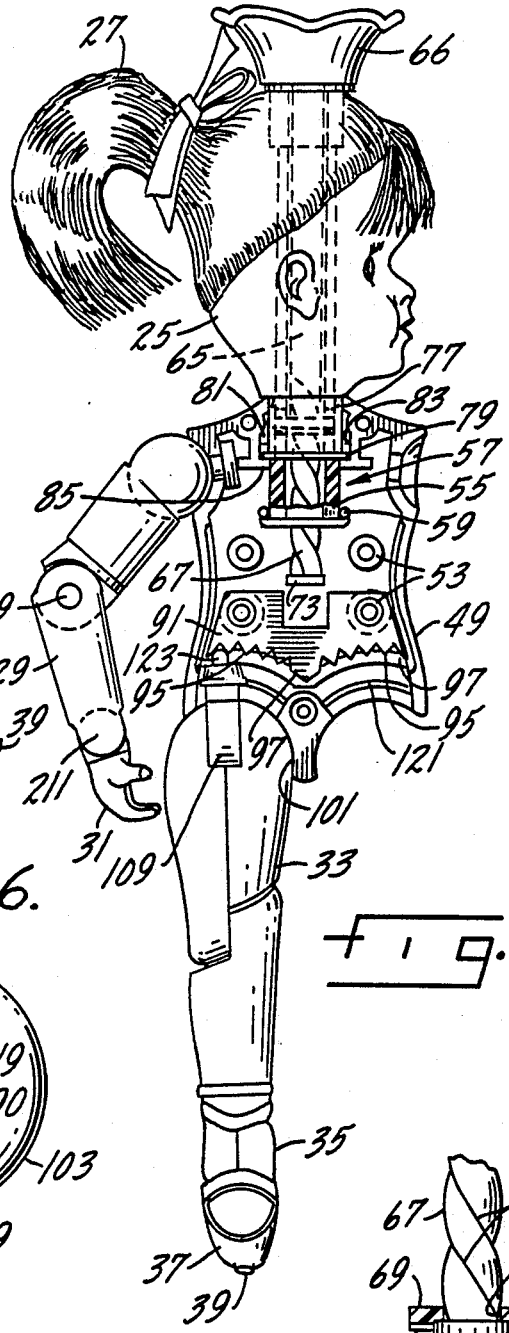
FIG. 2 is an enlarged, front elevational view of the doll of FIG. 1 with the front of the torso, one arm and one leg removed and other parts broken away or shown in dashed lines for clarity of illustration.
Figure 6:
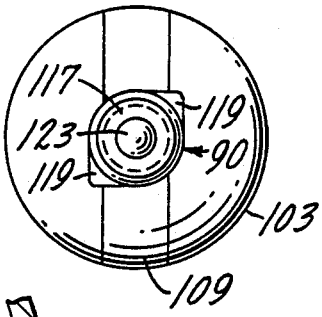
FIG. 6 is a top plan view of the thigh portion of a leg.
Figure 4:
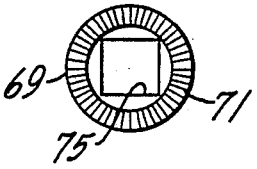
FIG. 4 is an end view of a drive disk of the pushrod mechanism of FIG. 3.
Figure 3:
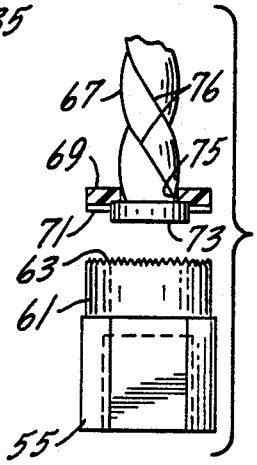
FIG. 3 is an enlarged, exploded view of a portion of the pushrod mechanism shown in FIG. 2 of the drawings.

A square drive nut 55 is shown in its installed position in the doll in FIG. 2 and is shown in an enlarged, exploded view in FIG. 3. The drive nut fits into a socket 57 formed by cooperating ribs 59 on the torso halves 47 and 49 of the doll. The drive nut has a cylindrical portion 61 on which are formed annular teeth 63, as shown in FIGS. 3 and 4 of the drawings. A pushrod 65 has a crown 66 at its upper end and a helical portion 67 formed at its lower end, as shown most clearly in FIG. 2 of the drawings. A drive disk 69 having teeth 71 corresponding to the teeth 63 of the drive nut 55 is mounted on the helical portion 67 of the pushrod 65 and is held by a collar 73 at the end of the pushrod. The drive disk has a square passage 75 which engages the flutes 76 of the helical portion 67 of the pushrod so that linear movement of the pushrod through the square passage 75 of the drive disk 69 causes rotation of the drive disk.

A tubular neck 77 connects the doll's head 25 to the torso 23. This tubular neck has a square flange 79 which fits into a socket 81 formed by ribs 83 on the body torso halves 47 and 49. Stops 85 also formed on the torso halves engage the square flange 79 to hold the tubular neck in position. The cylindrical portion 61 of the square drive nut 55 telescopes into the lower end of the tubular neck. Because the square drive nut 55 is held in the socket 57 by the cooperating ribs 59 and its engagement with the tubular neck 77, vertical movement of the pushrod 65 into the doll's head 25 and torso 23 will cause the drive disk 69 to engage the drive nut 55 to rotate it relative to the helical portion 67 of the pushrod 65, thus causing the doll's torso to rotate relative to the pushrod to provide a pirouetting effect for the doll as shown in FIG. 1 of the drawings. Upon withdrawal of the pushrod from the doll's head and torso, the drive disk 69 will be lifted from engagement with the teeth 63 on the cylindrical portion 61 of the square drive nut 55 so no reverse rotation occurs.

Figure 5:
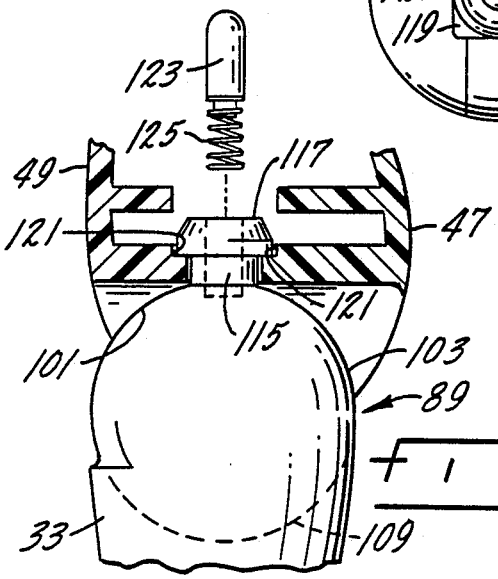
FIG. 5 is an enlarged, cross-sectional, exploded view of the connection between a leg and the torso.

In order to align a leg 33 vertically with the pushrod 65 and hold it in that position so the doll may be pirouetted or twirled in the manner shown in FIG. 1 of the drawings, a universal joint 89 and an overridable detent mechanism 90 are provided for each leg, as shown in detail in FIGS. 2, 5, 6 and 7 of the drawings. The overridable detent mechanism 90 includes a ratchet plate 91 mounted on the interconnecting hollow posts 53, as shown in FIG. 2 of the drawings. The ratchet plate 91 has teeth 95 arranged along two arcs 97. A socket 101 is formed in the front and rear halves 47 and 49 of the torso to receive a rounded thigh portion 103 of a leg 33. As shown in FIG. 7 of the drawings, the thigh portion 103 of the leg has an inner section 105 and an outer portion 107 clamping a disk 109 therebetween and held together by a screw 111. The disk 109 has a hollow stem 115 formed integrally therewith, as shown in FIG. 5 of the drawings, and a head 117 is formed on the stem. Ears 119 are formed on the head and these are offset 45 degrees relative to the axis of rotation of the disk, as shown most clearly in FIG. 6 of the drawings. The ears 119 ride in grooves 121, shown in FIG. 5 of the drawings, which grooves are formed in the front and rear torso halves 47 and 49 of the doll. A detent button 123 fits into the hollow stem and is biased by a spring 125 into engagement with the teeth 95 of the ratchet plate 91 in the manner shown in FIG. 2 of the drawings. The detent button 123 controls the lateral positioning of the leg 33 in selected positions of rotation determined by the teeth 95 of the ratchet plate 91.

Forward and rearward rotation of each leg is provided by an overridable detent mechanism 131, provided between the disk 109 and the inner and outer thigh sections 105 and 107, as most clearly shown in FIG. 7 of the drawings. Annular ratchet teeth 133 are formed in the bottom of a cylindrical socket 135 formed on one side of the disk 109. A separate, essentially flat disk 139 having ratchet teeth 141 and a square opening 143 in the center thereof (FIG. 8) is mounted on a square based stub 145 formed integrally with the outer thigh portion 107 of the leg. A coil spring 147 mounted over the stub 145 biases the teeth 141 of the flat disk 139 into engagement with the ratchet teeth 133 located at the bottom of the cylindrical socket 135 of the disk to lock the disk in position of rotation relative to the thigh sections 105 and 107. Because only the force of spring 147 is holding the teeth 133 and 141 in engagement, this selected position of rotation of the thigh relative to the torso can be overridden for rotation to a new position.

An overridable detent mechanism 149 is provided between the calf portion 151 of the leg and the outer thigh section 107 at what would be a knee to permit forward and aft rotation of the calf portion of the leg relative to the thigh portion, in other words, knee action. A cylindrical socket 153, shown in FIGS. 7 and 9 of the drawings, is formed at the lower end of the thigh section 107 and has an arcuate notch 155 at the periphery of the socket. A post 157 extends out the cylindrical passage and this post has a square base 159. A flat disk 161 having ratchet teeth 163 on one side thereof has a square opening 164 which fits on the square base 159 of the post to lock it against rotation. A drive disk 167 has teeth 169 corresponding to the teeth of the flat disk 161. A cylindrical socket 171 is formed in the calf at the top thereof and a slot 173 is formed in the periphery of the socket at the bottom thereof. The drive disk 167 has a tab 175 which fits into the slot 173 to hold the drive disk 167 in position relative to the calf 151. A coil spring 177 fits into the socket 153 of the thigh and biases the flat disk 161 and drive disk 167 into engagement with one another. A screw 179 extends through the calf and thigh portions to hold the assembly together. A tab 178 formed on the calf portion 151 at the top of the socket 171 fits into the arcuate notch 155 of the thigh portion 107 to limit rotation of the calf relative to the thigh.

A socket 181 is formed on the calf portion at the lower end thereof. As shown in FIG. 11 of the drawings, the socket has a notch 183 at the top. An annular drive disk 185 is provided with a tab 187 which fits into the notch 183. The annular drive disk 185 is formed with a pair of diametrically-opposed teeth 189 on the surface thereof facing the foot 35. An annular disk 193 fits into an annular socket 195 formed in the foot. A slot 197 extends diametrically out of the socket 195. A tab 199 extending outwardly from the disk 193 fits into the slot 197 to lock the disk relative to the foot. Slots 201 in the disk 193 engage the diametrically-opposed teeth 189 on the annular disk 185 and, under the influence of a spring 203, provide angular positions of releasable engagement for the foot 35 relative to the calf 151. A screw 205 extends through the foot 35 and into a hollow post 207 in the calf to hold the assembly together.

The arms 29 have ball joints connecting them to the torso, as shown in FIG. 2 of the drawings. The arms also have elbows 209 and wrists 211, but these are not equipped with detents relying on friction engagement which permits posing of the arms, but since the arms do not bear the stress that the legs do, releasable detents are not provided.

I claim:

1. A ballerina doll having a body, legs, feet, arms, hands and a head, a pushrod extending through the body and the head and mounted for reciprocal movement in and out of said body and head, means associated with said body and said pushrod to rotate said body relative to said pushrod as said pushrod is pushed into said body, means connecting each of said legs to said body and each of said feet to its leg to permit rotation of each leg relative to said body and each foot relative to its leg, and releasable detent means associated with said body, said legs and said feet to permit each leg to be held in selected positions of rotation relative to said body and to permit each foot to be held in selected positions of rotation relative to its leg.

2. The ballerina doll of claim 1 further characterized in that each leg includes an upper and a lower portion, means connecting said upper and lower portion to permit rotation of said portions relative to each other and releasable detent means to permit said upper and lower portions of the leg to be held in selected positions of rotation relative to each other.

3. The ballerina doll of claim 1 in which said means connecting each of said legs to said body to permit rotation of each leg relative to said body permits universal rotation of each leg relative to said body.

4. The ballerina doll of claim 3 in which said means permitting universal rotation of each leg relative to said body provides releasable means for holding each leg in selected positions of both lateral and fore and aft positioning relative to the body.

5. The ballerina doll of claim 1 further including means in each leg located at the knee to permit rotation of a lower portion of each leg relative to an upper portion.

6. The ballerina doll of claim 5 in which means permitting rotation of a lower portion of each leg relative to an upper portion also provides releasable means for holding said upper and lower portions in selected positions of rotation.

7. The ballerina doll of claim 1 in which said means associated with said body and said pushrod to rotate said body relative to said pushrod includes a drive nut affixed to said body and a drive disk mounted on said pushrod, meshable teeth formed on said drive nut and said drive disk and means to rotate said drive disk in engagement with said drive nut as said pushrod is pushed into said body.

8. The ballerina doll of claim 1 in which said releasable detent mean associated with said body and said legs include a toothed rack and a spring biased button which engages the tooth of said rack.

9. The ballerina doll of claim 1 in which said releasable detent means associated with said body and said legs include toothed disks associated with said body and said legs and spring means to bias the teeth of one disk into engagement with the teeth of the other disk.

* * * * *